US006019025A

United States Patent [19]

St. Amand

[11] Patent Number: 6,019,025

[45] Date of Patent: Feb. 1, 2000

[54] SHAPE MEMORY ALLOY ACTIVATED RETRACTABLE ELASTOMERIC SEALING DEVICE

[75] Inventor: Raymond A. St. Amand, Fairhaven, Mass.

[73] Assignee: The United States of America as represented by the Secretary of the Navy, Washington, D.C.

[21] Appl. No.: 09/056,351

[22] Filed: Apr. 7, 1998

[51] Int. Cl.[7] ..... F41F 3/04

[52] U.S. Cl. ..... 89/1.817

[58] Field of Search ..... 89/1.809, 1.81, 89/1.816, 1.817, 31; 114/316, 20.1, 238

[56] References Cited

U.S. PATENT DOCUMENTS

| | | | |
|---|---|---|---|
| 3,289,533 | 12/1966 | Brown | 89/1.81 |
| 3,300,888 | 1/1967 | Belcher et al. | 42/1.14 |
| 3,677,132 | 7/1972 | Plenge | 89/31 |
| 3,767,215 | 10/1973 | Brown | 277/125 |
| 4,429,854 | 2/1984 | Kar et al. | 384/94 |
| 4,537,406 | 8/1985 | Hirasun et al. | 277/1 |
| 4,739,027 | 4/1988 | Mendelsohn et al. | 528/60 |
| 5,226,683 | 7/1993 | Julien et al. | 285/363 |

*Primary Examiner*—Charles T. Jordan
*Assistant Examiner*—Jeffrey Howell
*Attorney, Agent, or Firm*—Michael J. McGowan; Robert W. Gauthier; Prithvi C. Lall

[57] ABSTRACT

A retractable seal replaces the existing o-ring seals on the Tomahawk Capsule Launching System (CLS). An elastomeric member is shaped to fit within the existing o-ring slot on the CLS and a cylindrical ring member of shape memory alloy circumscribes the elastomeric member. Under normal operating temperatures, the shape memory alloy member has a diameter large enough to allow the elastomeric member to extend beyond the diameter of the CLS so as to form a seal against the missile tube, yet small enough to not interfere with the seal. When the shape memory alloy member is heated, it contracts to a smaller predetermined diameter, compressing the elastomeric member within the o-ring slot so as to allow the movement of the CLS into or out of the missile tube without abrading the elastomeric member.

16 Claims, 2 Drawing Sheets

SHAPE MEMORY ALLOY ACTIVATED RETRACTABLE ELASTOMERIC SEALING DEVICE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to sealing devices, and more particularly to a retractable sealing device activated by a shape memory alloy ring.

(2) Description of the Prior Art

O-ring seals are used extensively to provide a pneumatic/hydrostatic seal between adjacent parts. In a typical application, a Tomahawk Capsule Launching System (CLS) is inserted in the missile tube of a submarine with dual o-ring seals providing the seal between the CLS and the missile tube. While this arrangement provides an effective seal in a static condition, the o-rings are susceptible to damage during installation and removal of the CLS from the missile tube. In order to provide an effective seal, the o-rings, in their free state, protrude beyond the outer diameter of the CLS. As a result, the o-rings suffer from abrasion damage as the CLS is moved into and out of the tube. While minor abrasion is common in o-ring seals between moving parts, the abrasion damage to the CLS o-rings typically results in a loss of the seal between the CLS and the missile tube due to the size of the CLS and o-rings.

In such applications where abrasion damage can lead to loss of an effective seal, a lip seal may be provided. A lip seal typically consists of an o-ring partially surrounded by an elastomeric material less susceptible to abrasion damage. When the CLS with a lip seal is inserted into the missile tube, the material surrounding the o-ring deforms to allow the o-ring to compress, thus forming a tight seal between the CLS and the missile tube. Though superior to the o-ring alone in resisting abrasion damage when the CLS is inserted into the missile tube, lip seals do suffer from damage during removal of the CLS from the missile tube. A seal which would be retractable when the CLS is inserted into or removed from the missile tube would prevent such damage from occurring.

A number of prior art devices have used shape memory alloys to provide retractable seals. U.S. Pat. No. 4,515,213 to Rogen et al. provides a packing tool for sealing spaces between the wall of a wellbore and tubing inserted into the wellbore. A sealing element is supported about the tubing. The sealing element contains a helical spring of shape memory alloy which maintains a radially contracted condition below a predetermined temperature. The tubing and sealing element are inserted into the wellbore. The shape memory alloy is heated and expands radially outward away from the tube and against an elastomeric material which maintains the seal between the wellbore and the tubing. A gripping element is also provided which consists of a shape memory alloy helical spring wound about the tube which expands in a longitudinal direction to force a wedged shape gripper against the wellbore. While the helical spring shape memory alloy retractable seal of Rogen et al. could be adapted for use on the CLS, the CLS would require substantial modifications to accommodate this seal. The size of the helical spring shape memory alloy element in the Rogen et al. seal precludes its use in replacing most standard o-ring seals without modifying the slots containing the o-rings.

U.S. Pat. No. 4,773,680 to Krumme provides a pipe coupler which utilizes retainer rings of shape memory alloy to both affix the pipe ends to the coupler and to seal the coupling. The retainer rings are deformed to form a concave-convex surface or a section of a conic. When heated, the rings return to their flat shape, biting into the metal of the coupling and the pipe. This action forms a seal and prevents the pipe from being removed from the coupling. While the Krumme coupler may be adapted to seal the CLS within a missile tube, it would damage both the CLS and the missile tube in forming the seal.

U.S. Pat. No. 5,132,873 to Nelson et al. provides a diaphragm sealing apparatus for sealing of an electronic component connected to a mating fluid heat exchanger. The diaphragm has an opening shaped to fit about the heat exchanger and forming a sealing lip. A clamping ring, which expands and contracts as a function of temperature is placed around the lip of the diaphragm and is subjected to a temperature to shrink the clamping ring against the lip and heat exchanger. The clamping ring arrangement of the Nelson et al. apparatus is used to hold the heat exchanger within the diaphragm by deforming against the heat exchanger. When a pressure seal is required, the clamping ring deforms into a compressible, soft metal ring provided on the heat exchanger. In either case, the clamping ring is attached to and deforms the diaphragm to connect the heat exchanger to the diaphragm. As with the Krumme coupler, the deformation of either the CLS or missile tube would be unacceptable.

SUMMARY OF THE INVENTION

Accordingly, it is an object of the present invention to provide a seal between a CLS and a missile tube which allows the CLS to be inserted and removed from the missile tube without damage to the seal.

Another object of the present invention is to provide a retractable seal which does not damage the CLS or missile tube.

Still another object of the present invention is to provide a seal which can be used in place of the existing o-ring seals without extensive modifications to the CLS or missile tube.

Other objects and advantages of the present invention will become more obvious hereinafter in the specification and drawings.

In accordance with the present invention, retractable seals are provided to replace the existing o-ring seals on the CLS. An elastomeric member is shaped to fit within the existing o-ring slot on the CLS and a cylindrical ring member of shape memory alloy circumscribes the elastomeric member. Under normal operating temperatures, the shape memory alloy member has a diameter large enough to allow the elastomeric member to extend beyond the diameter of the CLS so as to form a seal against the missile tube, but small enough so as not to interfere with the seal. When the shape memory alloy member is heated, it contracts to a smaller predetermined diameter, compressing the elastomeric member within the o-ring slot so as to allow the movement of the CLS into or out of the missile tube without abrading the elastomeric member. To insert the CLS within the tube, the shape memory alloy member is heated to compress the elastomeric member within the o-ring slot and the CLS is inserted into the tube. Once the CLS is properly seated within the missile tube, the shape memory alloy member is cooled. When sufficiently cooled the shape memory alloy member expands to a diameter large enough to allow the elastomeric member to make sealing contact between the CLS and the tube. When the CLS is to be removed from the tube, the shape memory alloy is again heated to compress the elastomeric member away from the tube to release the CLS. As only the elastomeric member makes contact with both the CLS and missile tube, the retractable seal of the present invention does not damage the CLS or tube. Further, the shape memory alloy cylindrical ring can be easily fabricated to fit within the existing o-ring slot of the CLS without extensive modifications to the CLS or the missile tube.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
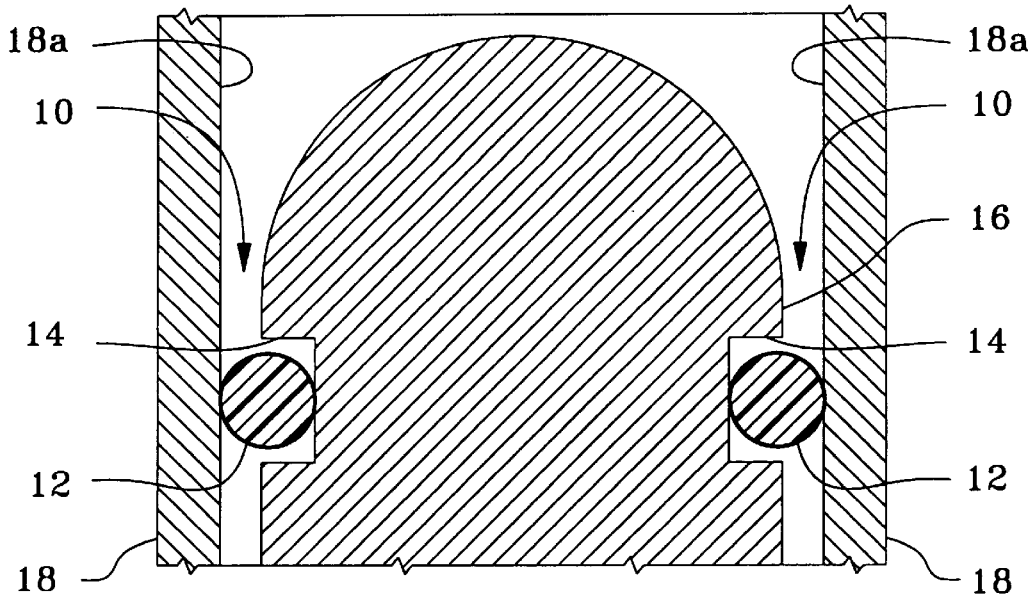
PRIOR ART FIG. 1
FIG. 1 is a cross sectional view of a prior art o-ring seal.

Referring now to FIG. 1, there is shown a cross sectional view of a typical prior art o-ring seal 10. O-ring 12 is seated within circumferential slot 14 on first member 16. First member 16 can be any cylindrical member, such as the Tomahawk Capsule Launching System (CLS). It can be seen in FIG. 1 that o-ring 12 has sufficient thickness to protrude beyond the diameter of first member 16. First member 16 is made to fit within second member 18 with a tolerance sufficient to compress o-ring 12 against inner wall 18*a* of second member 18 to form a tight seal. Second member 18 can be any hollow cylindrical member sized to accommodate first member 16, such as a submarine missile tube accommodates the CLS. It can be seen from FIG. 1, that as first member 16 is inserted into or removed from second member 18, o-ring 12 is abraded against inner wall 18*a*. Additionally, o-ring 12 may be torn or damaged by any sharp edges which may be present along wall 18*a*.

Figure 2:
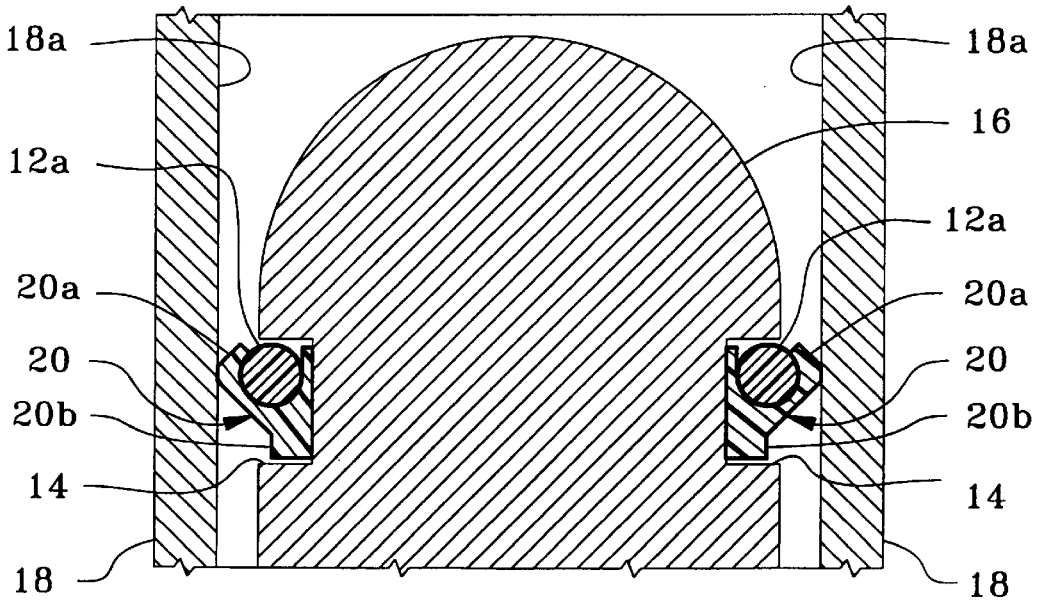
PRIOR ART FIG. 2
FIG. 2 is a cross sectional view of a prior art lip seal.

Referring now to FIG. 2, there is shown a prior art method used to reduce the abrasion of o-ring 12 of FIG. 1. Lip seal 20 is provided over reduced o-ring 12*a*. Lip seal 20 is made of a material more resistant to abrasion than reduced o-ring 12*a*. However, such materials do not form as efficient a seal as reduced o-ring 12*a*. Hence lip seal 20 has a cantilever section 20*a* which only partially covers reduced o-ring 12*a*. Cantilever section 20*a* provides an opening through which reduced o-ring 12*a* is inserted into lip seal 20. Body portion 20*b* of lip seal 20 occupies the remainder of slot 14. When first member 16 is inserted into second member 18, inner wall 18*a* pushes against cantilever section 20*a* which bends about reduced o-ring 12*a*, forming the necessary seal. While more resistant to abrasion than o-ring 12 of FIG. 1, lip seal 20 is still susceptible to damage from sharp edges within tube 18.

Figure 3A:
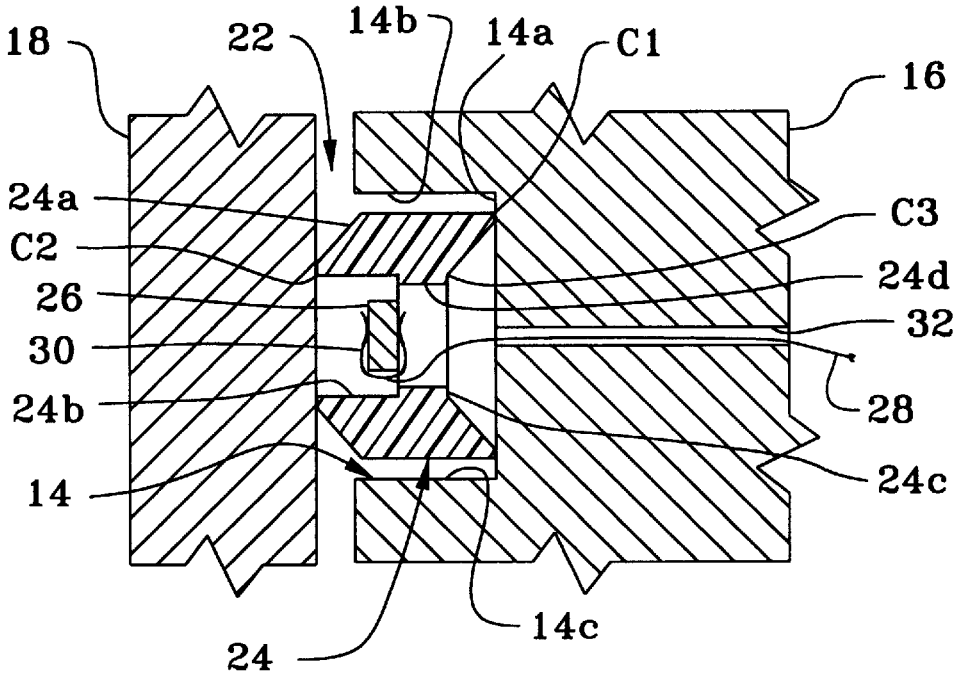
FIG. 3A is a partial cross section view of the seal of the present invention in a sealing mode.
Figure 3B:
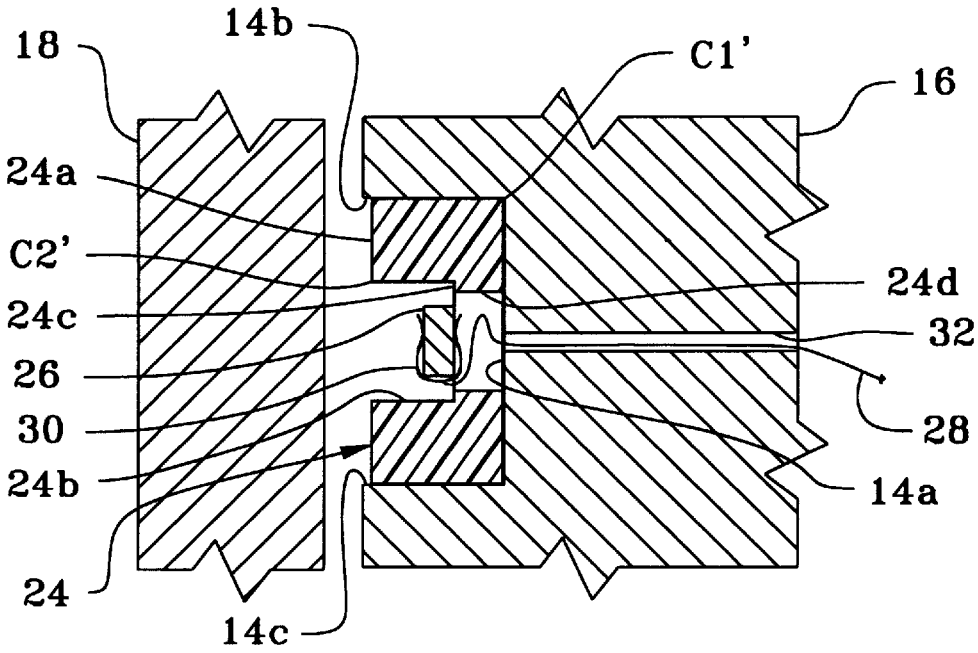
FIG. 3B is a partial cross sectional view of the seal of the present invention in a retracted mode.

Referring now to FIGS. 3A and 3B, there are shown cross sectional views of retractable seal 22 in a sealing mode and a retracted mode, respectively. It is to be noted that FIGS. 3A and 3B show partial cross sectional views and that a full cross sectional view would form a mirror image about the centerline of first member 16. Retractable seal 22 has an elastomeric ring member 24 which sits within slot 14. In the sealing mode of FIG. 3A, elastomeric member 24 has opposing leg portions 24*a* and 24*b* which are in the shape of parallelograms each having an acute angle at a corner, denoted C1 in FIG. 3A, in contact with bottom surface 14*a* of slot 14. The opposing acute angle corner, denoted C2 in FIG. 3A, extends beyond the diameter of first member 16 to form a seal between first member 16 and second member 18. It is noted that leg portions 24*a* and 24*b* do not contact side walls 14*b* and 14*c* of slot 14. Central portion 24*c* of elastomeric member 24 spans between the obtuse angle corners, denoted C3 in FIG. 3A, of leg portions 24*a* and 24*b* such that central portion 24*c* is raised away from bottom surface 14*a* of slot 14. Shape memory alloy member 26 forms a cylindrical ring about central portion 24*c*. The thickness of central portion 24*c* and the diameter of shape memory alloy member 26 is such that shape memory alloy member 26 does not protrude beyond leg portions 24*a* and 24*b* and does not come in contact with second member 18. As is well known in the art, shape memory alloys exhibit one-way memory, i.e., a shape memory alloy part deformed while in the martensitic state will return to its original shape when heated above its austenitic finish temperature. To repeat this cycle, the part must be cooled to within its martensitic temperature range, deformed once more and reheated above its austenitic finish temperature. As is also well known in the art, shape memory alloy parts can be processed to attain a two-way memory, i.e., the part returns to its deformed martensitic shape upon cooling. In the preferred embodiment of the present invention, shape memory alloy member 26 has been processed to exhibit a two-way memory. FIG. 3A illustrates the deformed martensitic shape with shape memory alloy member 26 having a larger diameter in FIG. 3A than in FIG. 3B. To obtain the retracted shape of FIG. 3B, shape memory alloy member 26 is heated above its austenitic finish temperature. Within this range, shape memory alloy member 26 contracts to a minimum predetermined diameter, causing central portion 24*c* to rest against bottom surface 14*a*. Leg portions 24*a* and 24*b* are correspondingly deformed to form right angle parallelograms such that they no longer protrude beyond the diameter of first member 16. It can be seen in FIG. 3B, that to accommodate this movement, leg portions 24*a* and 24*b* are forced outward against side walls 14*b* and 14*c*. The corners C1' are now compressed into the corners formed by side walls 14*b* and 14*c* and bottom surface 14*a*. Thus, to install first member 16 into second member 18, shape alloy member 26 is heated to above its austenitic finish temperature so as to contract to its predetermined diameter. The contraction of shape memory alloy member 26 causes elastomeric member 24 to retract into slot 14, thus allowing first member 16 to be inserted into second member 18 without abrading elastomeric member 24 and without having any sharp edges on second member inner surface 18*a* cause damage to elastomeric member 24. Once first member 16 is seated within second member 18, shape memory alloy member 26 is allowed to cool and return to its larger martensitic diameter. Central portion 24*c* of elastomeric member 24 pulls away from bottom surface 14*a* of slot 14 such that leg portions 24*a* and 24*b* of elastomeric member 24 resume their acute/obtuse parallelogram shape with corners C2 sealing against second member 18. In the preferred embodiment shown, heating of shape memory alloy member 26 is accomplished by providing an electrical current through shape memory alloy member 26. Of the well known shape memory alloys of commercial importance, nickel-titanium is suitable for heating electrically due to its high resistivity. Electrical lead 28 passes through lead slot 24*d* cut into elastomeric member 24 and is attached to shape memory alloy member 26. To facilitate removal of seal 22 from first member 16, lead 28 is attached to shape memory alloy member 26 via clip 30. In order to insure uniform heating of shape memory alloy member 26, the second electrical lead (not shown) would be placed 180° from electrical lead 28. Electrical lead 28 can be routed through first member 16 in any manner. In the preferred embodiment of FIGS. 3A and 3B, electrical passageway 32 is provided in first member 16. Advantage can also be taken of the use of nickel-titanium in that two-way memory training of nickel-titanium alloys leads to only partial shape recovery upon cooling. Thus, for initial installation, the martensitic diameter of shape memory alloy ring 26 can be made large enough to slip over first member 16. When heated to above its austenitic finish temperature, ring 26 would contract over and seat elastomeric member 24 into o-ring slot 14. When cooled, the partial shape recovery leads to a slightly smaller martensitic diameter which maintains elastomeric member 24 and shape memory alloy ring 26 in place within o-ring slot 14.

The invention thus described provides a retractable seal which is fabricated to replace an existing o-ring seal between a first member and a second member, the first member being in the general shape of a solid cylinder and being received within a hollow cylindrical portion of the second member. The retractable seal has an elastomeric member which fits within the existing o-ring slot of the first member, replacing the o-ring. Two outer leg portions of the elastomeric member extend beyond the diameter of the first member to contact the second member. The leg portions are connected by a central portion which is raised slightly above the base of the o-ring slot. A cylindrical ring of shape memory alloy surrounds the central portion between the leg portions. The shape memory alloy cylindrical ring is fabricated to have an undeformed or austenitic inner diameter equal to or slightly less than the o-ring slot diameter plus the thickness of the central portion of the elastomeric member. The deformed or martensitic diameter of the shape memory alloy cylindrical ring is fabricated such that the diameters and thicknesses of the central portion of the elastomeric ring and the surrounding cylindrical ring do not interfere with the sealing of the leg portions and the second member. The actual inner diameter of the martensitic shape is equal to or slightly larger than the outer diameter of the central portion during normal operating conditions of the first and second members. This assures that the shape memory alloy ring does not impart any residual load on the elastomeric ring which could reduce the sealing capacity of the elastomeric ring under normal operating conditions. The shape memory alloy ring is trained to have a two-way memory, i.e., the ring maintains its martensitic shape during normal operating conditions, returns to its undeformed shape when heated above its austenitic finish temperature and then returns to the martensitic shape when cooled. To install the first member within the second, the shape memory alloy is heated by passing an electric current through the ring so as to bring the temperature of the shape memory alloy ring above its austenitic finish temperature. When so heated the shape memory alloy ring reverts to its undeformed shape having the smaller diameter and compresses the elastomeric ring central portion into and against the base of the o-ring slot. This action also pulls the leg portions of the elastomeric ring into the slot such that they do not protrude past the diameter of the first member. The first member can then be inserted into the second member without damaging the seal. Once the first member is seated within the second member, the shape memory alloy ring is allowed to cool, thus reverting to the larger martensitic diameter. The leg portions protrude from the o-ring slot to make contact with the second member, forming the seal. To remove the first member from within the hollow cylindrical portion of the second member, the shape memory alloy ring is again heated, retracting the leg portions within the slot such that the first member can be removed without damaging the elastomeric ring. Once the first member is removed, the cylindrical ring is allowed to return to normal operating conditions, thus returning to its larger martensitic diameter. However, the martensitic diameter of the cylindrical ring is small enough such that both the cylindrical ring and elastomeric ring are held within the o-ring slot with the first member removed from within the second.

Although the present invention has been described relative to a specific embodiment thereof, it is not so limited. The shape memory alloy ring could be heated by means other than electrical resistive heating, allowing for the use of other shape memory alloys besides nickel-titanium. For example, it may be possible in some applications to heat the environment surrounding the seal in order to contract the shape memory alloy ring. The shape of the elastomeric member can be reconfigured to suit operating conditions. In the preferred embodiment, the shape memory alloy ring is separate from the elastomeric member. This allows replacement of the elastomeric member while reusing the shape memory alloy ring. However, it may be beneficial to have the shape memory alloy ring embedded within the elastomeric member. In this way, the contraction of the shape memory alloy ring would pull the elastomeric member away from the second member. Additionally, the recovery of the shape memory alloy could be such as to push the elastomeric member against the second member to form a tighter seal. While nickel-titanium provides good corrosion resistance, other alloys may require embedment within the elastomeric member to prevent corrosion. The preferred embodiment of FIGS. 3A and 3B is in the general shape of an o-ring seal providing a seal between a cylindrical first member within a hollow cylindrical portion of a second member. However, the seal can be fabricated into virtually any shape to seal between any two adjacent members. Additionally, while the preferred embodiment indicates the elastomeric member placed on the first, or interior member, some applications may require the elastomeric member to be placed within a slot in the cylindrical wall of the second member. In these cases, the shape memory alloy ring would expand when heated to retract the elastomeric member into the slot. Further, the device may be used to deliver measured quantities of a liquid by using two or more seals containing a measured volume between them. First one seal is retracted to allow a liquid to flow into the measured volume. This first seal is then closed, containing the liquid between the seals. Next, the second seal is retracted allowing the measured volume of liquid to flow out from between the seals. The second seal is closed and the process is repeated.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A retractable seal between a first member and a second member comprising:

an elastomeric member fitted against the first member and extending away from the first member into sealable contact with the second member; and a third member formed of a shape memory alloy, the third member having a first shape under normal operating conditions to allow the elastomeric member into sealable contact with the second member, the third member assuming a second shape when heated, the second shape retracting the elastomeric member away from sealable contact with the second member.

2. The retractable seal of claim 1 further comprising a slot formed on the first member, the elastomeric member being fitted partially within the slot under normal operating conditions, the second shape retracting the elastomeric member completely within the slot.

3. The retractable seal of claim 2 wherein the elastomeric member further comprises:

a central portion contained within the slot, the central portion being between the third member and a base surface of the slot, the central portion being raised away from the base surface; and leg portions connected at either side of the central portion, the leg portions extending away from the central portion to form the sealable contact with the second member, the second shape forcing the central portion into contact with the base surface, the movement of the central portion towards the base surface retracting the leg portions within the slot.

4. The retractable seal of claim 1 further comprising electrical leads attached to the third member, the electrical leads for passing an electrical current through the third member to heat the third member to assume the second shape.

5. The retractable seal of claim 3 wherein the first member is cylindrical, fitting within a hollow cylindrical portion of the second member, the slot being circumferential about the first member, the elastomeric member and the third member being in the general shape of rings, the first shape having a larger diameter than the second shape.

6. The retractable seal of claim 5 further comprising electrical leads attached to the third member, the electrical leads for passing an electrical current through the third member to heat the third member to assume the second shape.

7. The retractable seal of claim 6 wherein the electrical leads are attached to the third member at diametrically opposite points.

8. The retractable seal of claim 7 further comprising removable clips for attaching the electrical leads to the third member.

9. The retractable seal of claim 8 further comprising an electrical passageway passing through the elastomeric member and the first member for passage of the electrical leads.

10. The retractable seal of claim 3, wherein the third member is fabricated of nickel-titanium shape memory alloy.

11. The retractable seal of claim 10, wherein the third member is trained to have a two-way memory so as to return to the first shape when cooled after being heated to assume the second shape.

12. A retractable seal replacing an existing o-ring seal between a first cylindrical member having a circumferential slot for receiving an o-ring, and a hollow cylindrical portion of a second member, the retractable seal comprising:

an elastomeric member placed partially within the slot and partially extending away from the first member into sealable contact with the second member; and a shape memory alloy ring member surrounding a portion of the elastomeric member within the slot, the ring member having a first diameter sufficient to secure the elastomeric member partially within the slot, the ring member assuming a second, smaller diameter when heated, the second, smaller diameter sufficient to compress the elastomeric member within the slot and away from sealable contact with the second member.

13. The retractable seal of claim 12 wherein the elastomeric member further comprises:

a central portion contained within the slot, the central portion being between the ring member and a base surface of the slot, the central portion being raised away from the base surface; and leg portions connected at either side of the central portion, the leg portions extending away from the central portion to form the sealable contact with the second member, the second, smaller diameter of the ring member forcing the central portion into contact with the base surface, the movement of the central portion towards the base surface retracting the leg portions within the slot.

14. The retractable seal of claim 13 wherein the ring member is fabricated of nickel-titanium shape memory alloy.

15. The retractable seal of claim 14 wherein the ring member is trained to have a two-way memory so as to return to the first diameter when cooled after being heated to assume the second, smaller diameter.

16. The retractable seal of claim 15 wherein the ring member has an original diameter larger than the first diameter, the original diameter sufficient to allow the ring member to be installed over the first member and leg portions of the elastomeric member, the ring member assuming the second, smaller diameter upon a first heating, the ring member returning to the first diameter when cooled from the first heating and subsequent heatings.

* * * * *